US005839892A

United States Patent [19]

Hwang

[11] Patent Number: 5,839,892

[45] Date of Patent: Nov. 24, 1998

[54] ELECTRONIC LIGHTER WITH A SAFETY DEVICE

[76] Inventor: Ing Feng Hwang, No. 2, Lane 22, Sec. 2, Rd., Shan-shi Taichung, Taiwan

[21] Appl. No.: 622,713

[22] Filed: Mar. 26, 1996

[51] Int. Cl.[6] ..... F23D 11/36

[52] U.S. Cl. ..... 431/153; 431/277; 431/255

[58] Field of Search ..... 431/153, 277, 431/267, 255, 131, 253

[56] References Cited

U.S. PATENT DOCUMENTS

| | | | |
|---|---|---|---|
| 4,904,180 | 2/1990 | Nitta | 431/153 |
| 5,145,358 | 9/1992 | Shike et al. | 431/153 |
| 5,350,294 | 9/1994 | Iwahori | 431/153 |
| 5,462,432 | 10/1995 | Kim | 431/153 |

*Primary Examiner*—Larry Jones

[57] ABSTRACT

An improved electronic lighter with a safety device includes a liquid gas container and a seat provided on a top end of the gas container, the seat having disposed thereon a gas nozzle and a piezo-electric element controllable by a press button means. The press button means consists of an upper cover and a press cylinder capable of slidable engagement. The press cylinder is a hollow structure having two hook-like ends which may be movably inserted into a pair of second guide slots located slightly to the back of a pair of first guide slots of an electrode plate of the piezo-electric element. The upper cover has two hook-like ends at a front end thereof for matching the hook-like ends of the press cylinder such that the hook-like ends of the upper cover are retained by a step portion near an upper end of each second guide slot when the lighter is not in use. A spring element is disposed between the upper cover and the press cylinder such that, after the upper cover is moved backwardly so that its hook-like ends lap over the hook-like ends of the press cylinder in the second guide slots, the upper cover and the press cylinder may be pressed downwardly to press the spring element to achieve ignition.

2 Claims, 6 Drawing Sheets

ELECTRONIC LIGHTER WITH A SAFETY DEVICE

BACKGROUND OF THE INVENTION (a). Field of the Invention

The present invention relates generally to an electronic lighter, and more particularly to an improved electronic lighter with a safety device of a simple construction, which may be manufactured at relatively low costs.

(b). Description of the Prior Art

As conventional disposable cigarette lighters are inexpensive and convenient, they are very popular. However, since they are easy to operate, even children can use them with facile, which may result in fire accidents. In view of this, various advanced nations, like the United States and Japan, have set up laws to prohibit sale of such cheap, disposable cigarette lighters which are without any safety devices.

Medium-price electronic lighters with no safety devices are also prohibited from sale. Conventional electronic lighters are generally of the same size as that of the disposable lighters. They are provided with a liquid gas container, a gas release mechanism on an upper side of the gas container and a piezoelectric element controllable by a press button.

In conventional electronic lighters having safety devices, the arrangement is to provide an exposed safety control element which is operated before the press button of the lighter is pressed, which is rather inconvenient in operation. Besides, considerable modification has to be made to the structural elements, which means higher costs.

SUMMARY OF THE INVENTION

Accordingly, a primary object of the present invention is to provide an improved electronic lighter with a safety device which does not require considerable change in structural elements and may be operated with convenience.

In order to achieve the above-mentioned object, the electronic lighter of the invention is provided with a control press button means of the lighter consists of an upper cover and a press cylinder, the press cylinder having two ends capable of being respectively retained by a guide slot pre-disposed in either lateral side wall of a seat at the upper side of a liquid gas container, the upper cover having two front ends respectively checked by a step portion of the guide slot when the lighter is not in use. The upper cover is pushed backwardly and press simultaneously to achieve ignition.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
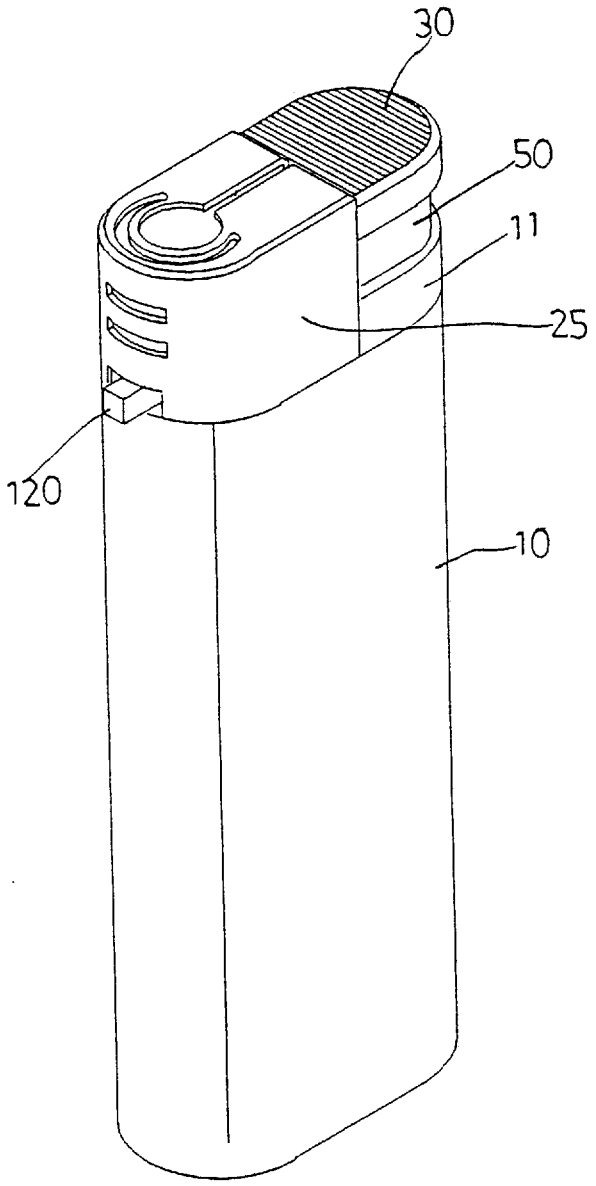
FIG. 1 is an elevational view of the lighter of the invention.
Figure 2:
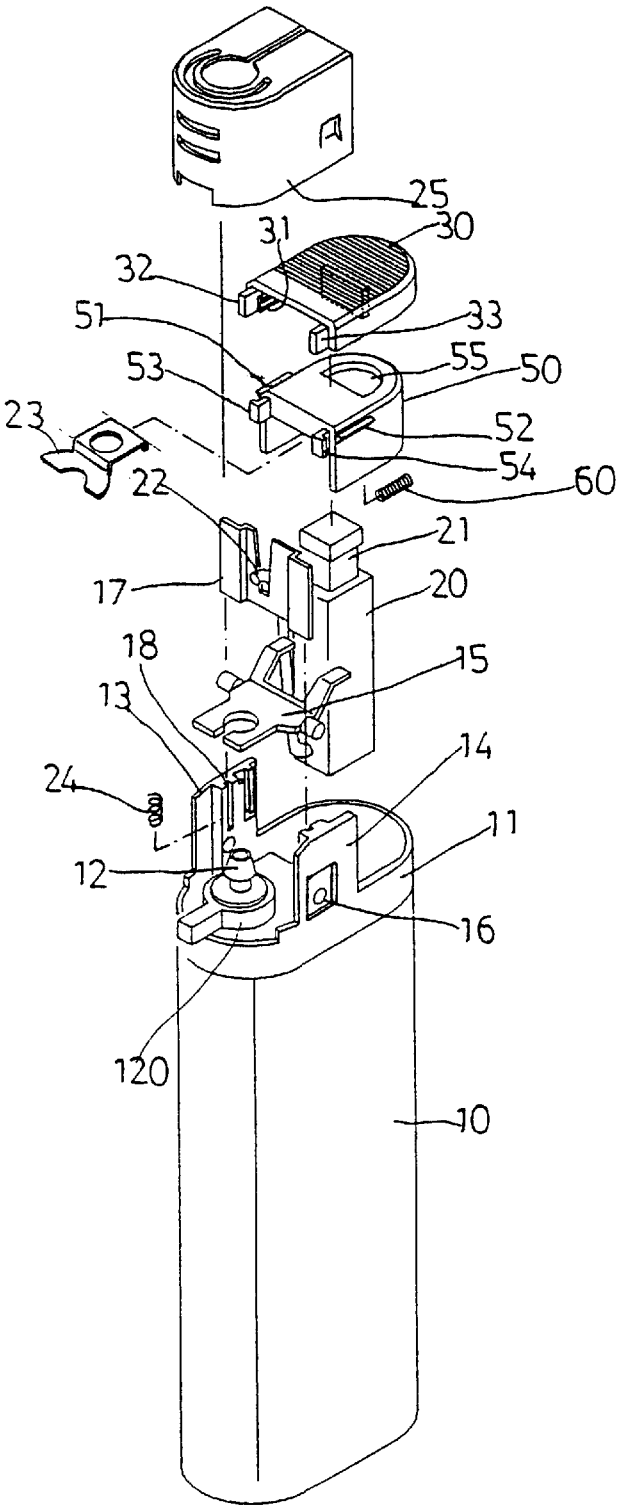
FIG. 2 is an exploded view of the lighter of the invention.

With reference to FIG. 1, like conventional lighters, the improved lighter according to the present invention is comprised of a liquid gas container 10 and a seat 11 fixedly coupled to a top side thereof. With reference to FIG. 2, the seat 11 has a gas nozzle 12 disposed at one end of its upper side, and a gas flow regulating wheel 120 is provided below the gas nozzle 12. A first wall 13 and a second wall 14, each having a hole 16 and a first guide slot 18, extend integrally from the front and rear sides of the seat 11 respectively. A trigger lever 15 has its ends movably inserted into the holes 16 of the first and second walls 13 and 14 so that it may be caused to lift the gas nozzle 12 to release the gas. An electrode plate 17 is sandwiched between the first guide slots 18 of the first and second walls 13 and 14, whereas a piezo-electric element 20 is vertically disposed in the seat 11. The piezo-electric element 20 includes a piezo-electric switch 21 and a spark outlet tube 22 projecting from a V-shaped notch pre-formed in the electrode plate 17. Besides, an electrically conductive piece is provided between the piezo-electric element 20 and a control button; an electrically conductive spring 24 is disposed at a lower position; and a cover 25 is provided for concealing most of the components and allowing the passage of the flame. As these structural parts resemble those in the conventional lighters, they are not described in detail herein.

Figures 3, 4:
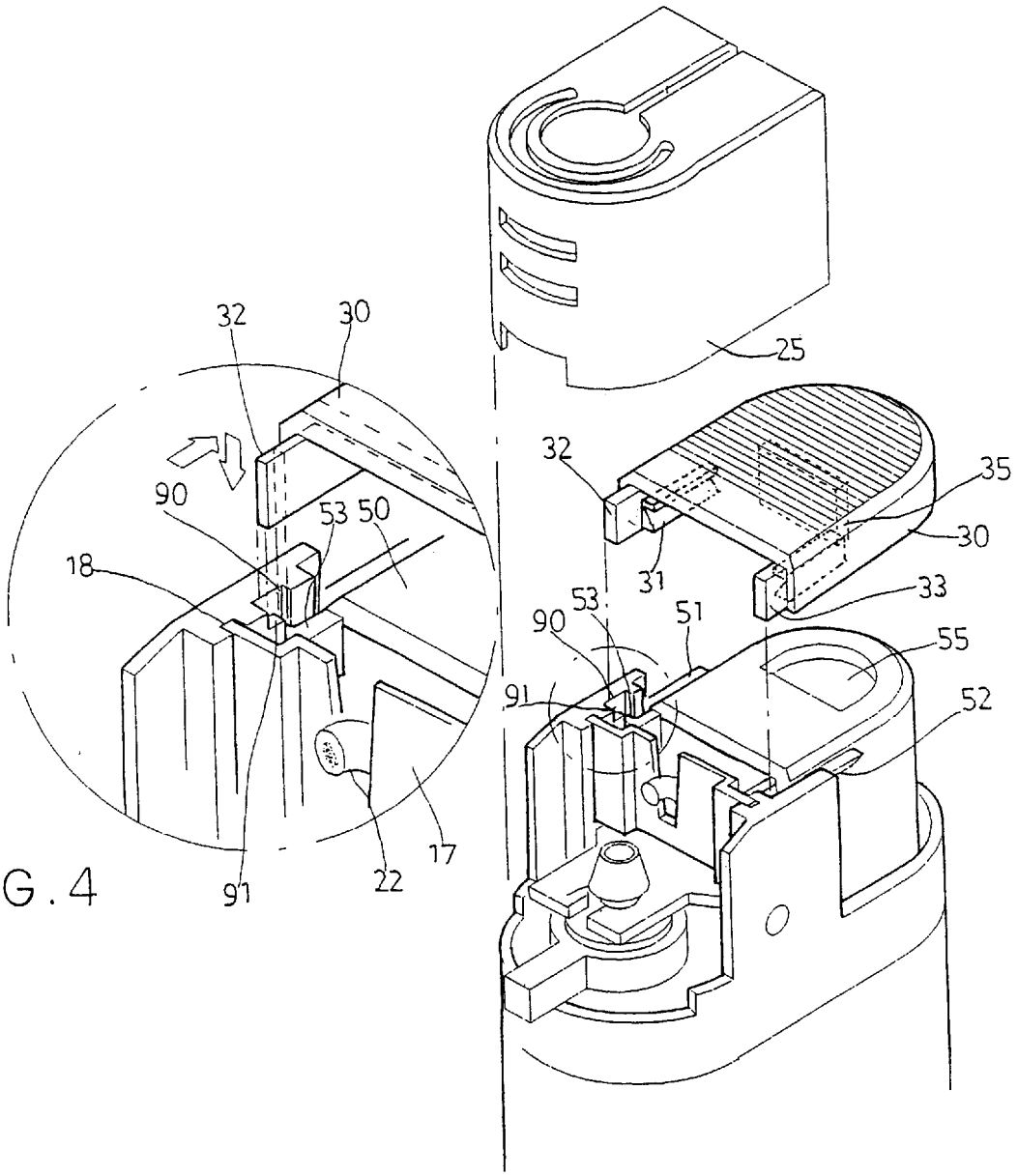
FIG. 3 is an exploded view of the lighter of the invention in part.
FIG. 4 is an enlarged view of FIG. 3 in part.

With reference to FIGS. 3 and 4, the control press button means of the improved lighter according to the present invention consists of an upper cover 30 and a press cylinder 50, which may be slidably engaged with one another. In the embodiment shown in FIGS. 3 and 4, the press cylinder 50 has two side walls which are respectively provided with guide strips 51, 52 for slidably engaging two rails 31 disposed at the inner side walls of the upper cover 30. It should be understood to those skilled in the art that the guide strips may be disposed at the upper cover and the rails may be correspondingly provided on the press cylinder. Similar modification like curved strips and curved rails may be arranged to achieve similar effects. In addition, the press cylinder 50 is configured to be substantially hollow so that it may be fitted onto the surface of the piezo-electric switch 21 of the piezo-electric element 20. The press cylinder 50 is further provided with two hook-like portions 53, 54 (see FIG. 2) at both lateral sides of a front end thereof so that it may be movably assembled to a pair of second guide slots 90 provided to the back of the first and second side walls 13 and 14 respectively. Each of the second guide slots 90 has a step portion 91 near an upper front end thereof.

Likewise, the upper cover 30 is provided with two hook-like portions 32 and 33 of a shape substantially the same as that of the hook-like portions 53 and 54 of the press cylinder 50 except that they are longer and wider. When the upper cover 30 is slidably fitted onto the press cylinder 50, the hook-like portions 32 and 33 of the upper cover 30 may overlap the hook-like portions 53 and 54 of the press cylinder 50 with their hook ends hooking the step portions 91 of the second guide slots 90.

Figure 5:
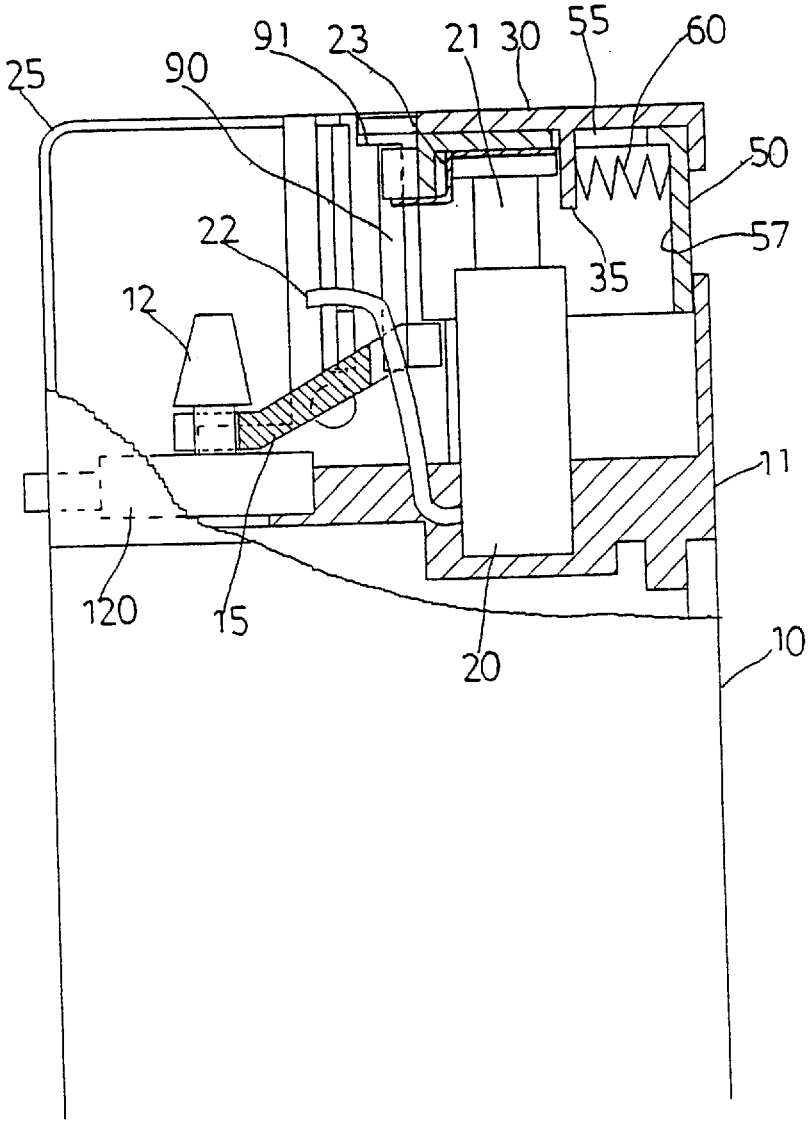
FIG. 5 is a sectional view of the lighter shown in FIG. 1, showing the lighter not in use.

Furthermore, a pressure spring means may be provided between the upper cover 30 and the press cylinder 50. In the embodiment shown in FIGS. 5, 6 and 7, a slot 55 if formed in the surface of the press cylinder 50, while a drooping insert piece 35 is correspondingly provided on the upper cover 30 such that, when the upper cover 30 and the press cylinder 50 are slidably coupled together, the insert piece 35 may pass through the slot 55 into the interior of the press cylinder 50 so that a spring element 60 may be inserted between the insert piece 35 and an inner wall 57 of the press cylinder 50 (see FIG. 5).

Figure 6:
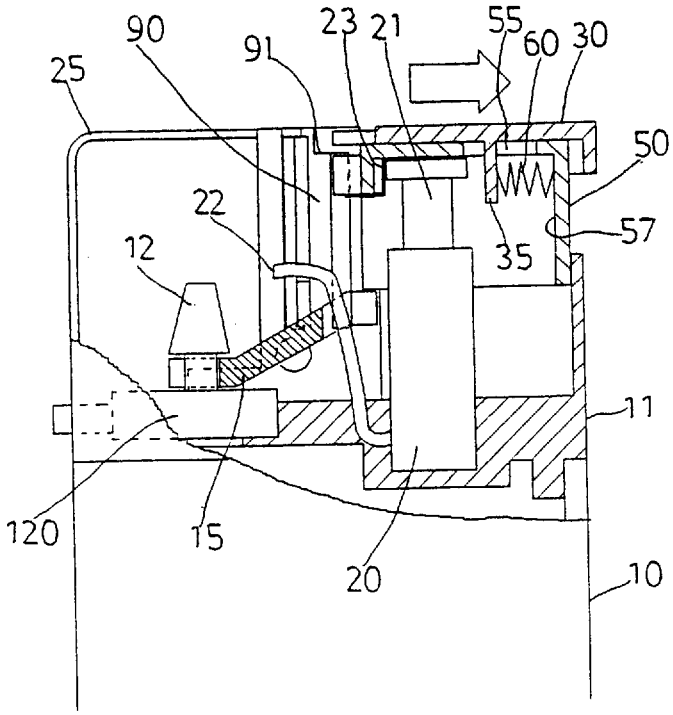
FIG. 6 is similar to FIG. 5, but showing an upper cover of the lighter of the invention pushed backwardly.
Figure 7:
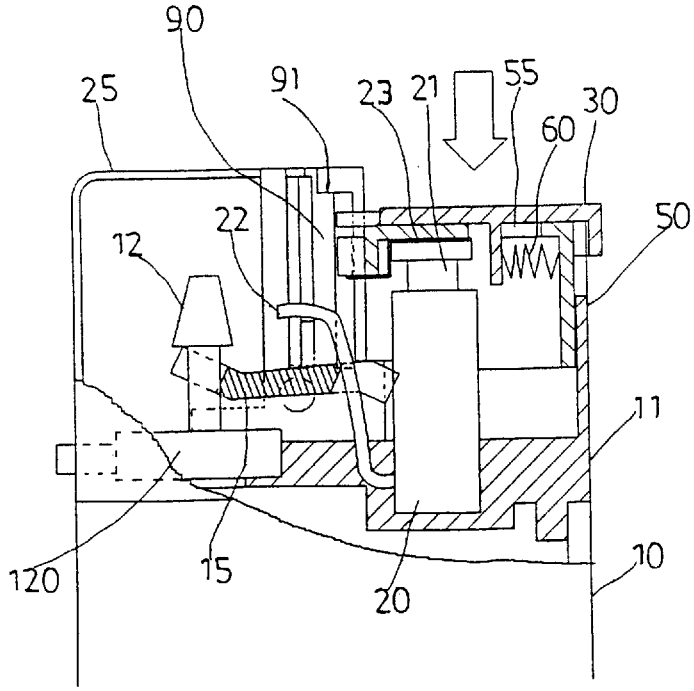
FIG. 7 is similar to FIG. 6, but showing the press button control means of the invention pressed downwardly.
Figure 8:
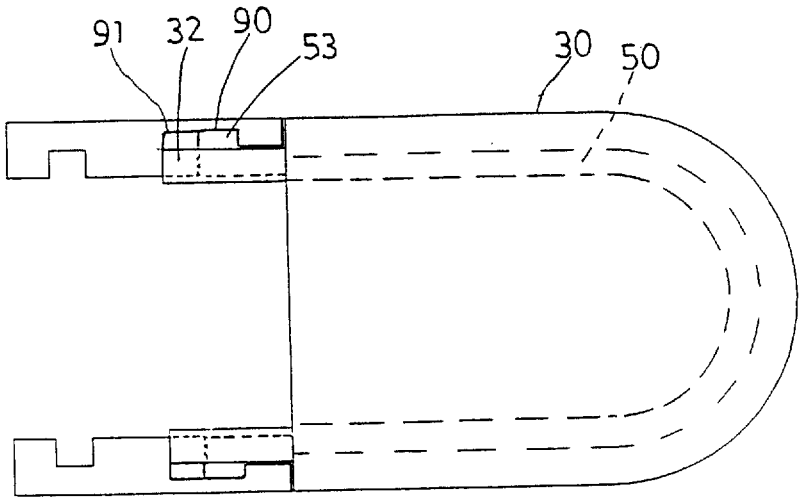
FIG. 8 is a top view of the lighter of the invention, showing the relative positions of the upper cover and a press cylinder when the lighter is not in use.
Figure 9:
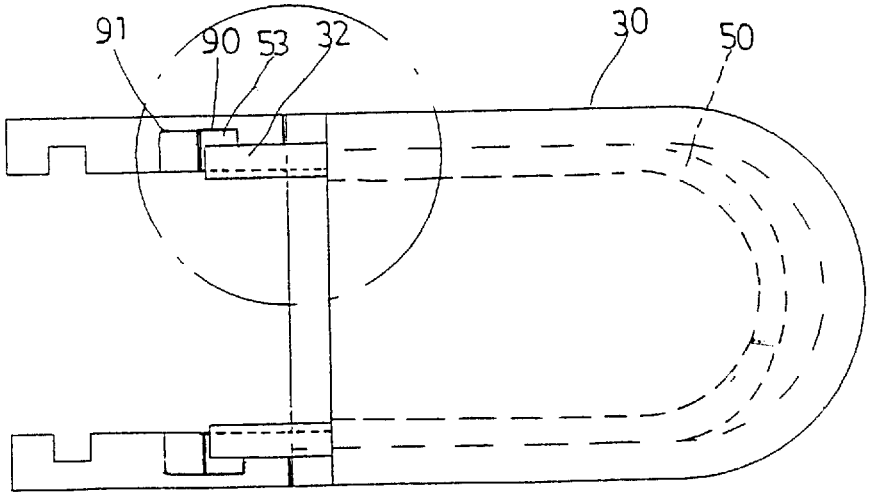
FIG. 9 is similar to FIG. 8, but showing the relative positions of the upper cover and the press cylinder when the upper cover is moved backwardly.

With reference to FIGS. 6 and 8, when the improved lighter of the invention is not in use, the respective hook ends of the hook-like portions 32 and 33 of the upper cover 30 are checked by the step portions 91 of the guide slots 90. But when a force is exerted upon the upper cover 30 so that it moves backwardly to a certain distance and the spring element 60 between the upper cover 30 and the press cylinder 50 is pressed, as shown in FIGS. 6 and 9, the hook ends of the hook-like portions 32 and 33 will lap over the hook-like portions 53 and 54 so that they may be pressed downwardly in the guide slot 90 together with the press cylinder 50 (see FIG. 7), thereby actuating the piezo-electric element 20. At the same time, gas is released from the gas nozzle 12 by the action of the trigger lever 15 so that a flame is started. When the pressure upon the upper cover 30 is released, a spring element (not shown) of the piezo-electric element 20 and the spring element 60 intermediate the upper cover 30 and the press cylinder 50 will cause the hook-like portions 32 and 33, 53 and 54 to reset to their original positions.

In the present invention, the arrangement of the upper cover 30 and the press cylinder 50 and the step portion of the second guide slots 90 of the seat 11 constitute a safety device for the lighter which may be manufactured at a relatively lower cost with a simpler construction. Furthermore, operation of the lighter of the invention is relatively smoother since it is only necessary to press the upper cover 30 so that it moves backwardly to a certain extent and to press the press cylinder 50 in order to achieve ignition.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved electronic lighter with a safety device of the type consisting of a liquid gas container and a seat provided on a top end of said gas container, said seat having a gas nozzle and a piezo-electric element disposed thereon, said improvement comprising:

a control press button means for controlling said piezo-electric element, said control press button means consisting of an upper cover and a press cylinder capable of slidable engagement, said press cylinder being a hollow structure having two hook-like ends which may be movably inserted into a pair of second guide slots located slightly to the back of a pair of first guide slots of an electrode plate of said piezo-electric element, said upper cover having two hook-like ends at a front end thereof for matching said hook-like ends of said press cylinder such that said hook-like ends of said upper cover are retained by a step portion near an upper end of each of said second guide slots when the lighter is not in use, a spring element being disposed between said upper cover and said press cylinder such that, after said upper cover is moved backwardly so that said hook-like ends thereof lap over said hook-like ends of said press cylinder in said second guide slots, said upper cover and said press cylinder may be pressed downwardly to press said spring element to achieve ignition.

2. The improved lighter as claimed in claim 1, wherein said press cylinder has a slot provided at a suitable position in an upper surface thereof for receiving an insert piece correspondingly provided on said upper cover, said insert piece being capable of extending through said slot into the interior of said press cylinder, and said spring element being disposed between an inner wall of said press cylinder and said insert piece.

* * * * *